US005330331A

United States Patent [19]

Doede

[11] Patent Number: 5,330,331

[45] Date of Patent: Jul. 19, 1994

[54] METERING PUMP FOR HIGHLY VISCOUS FILLINGS

[75] Inventor: Klaus Doede, Verl, Fed. Rep. of Germany

[73] Assignee: Klockner Hansel GmbH, Hanover, Fed. Rep. of Germany

[21] Appl. No.: 970,258

[22] Filed: Nov. 2, 1992

[30] Foreign Application Priority Data

Nov. 2, 1991 [DE] Fed. Rep. of Germany ..... 4136097

[51] Int. Cl.[5] ..... F04B 7/00

[52] U.S. Cl. ..... 417/519; 417/900

[58] Field of Search ..... 417/517, 519, 900

[56] References Cited

U.S. PATENT DOCUMENTS

| | | | |
|---|---|---|---|
| 1,066,660 | 7/1913 | Ross | 417/519 |
| 2,017,975 | 10/1935 | Kooyman | 417/900 |
| 2,032,163 | 2/1936 | Bagby | 417/519 |
| 2,125,283 | 8/1938 | Campbell | 417/517 |
| 2,384,783 | 9/1945 | Longenecker | 417/900 |
| 2,448,104 | 8/1948 | Longenecker | 417/519 |
| 3,506,382 | 4/1970 | Zurich | 417/900 |
| 3,552,440 | 1/1971 | Smith | 417/900 |

FOREIGN PATENT DOCUMENTS

| | | |
|---|---|---|
| 1010377 | 6/1957 | Fed. Rep. of Germany . |
| 1013519 | 8/1957 | Fed. Rep. of Germany . |

*Primary Examiner*—John J. Vrablik
*Assistant Examiner*—Peter Korytnyk
*Attorney, Agent, or Firm*—Hopkins & Thomas

[57] ABSTRACT

A metering pump for highly viscous fillings has a crankshaft-type drive for a back-and-forth movement of a piston (1) in a cylinder (2) and a drive for a forward-and-backward rotational movement of a rotary slide valve (4) derived from this. The rotary slide valve (4) has openings and the housing of said rotary slide valve has connections for a suction line (7) and a discharge line (8) for the piston/cylinder unit (1, 2). A plate cam, coupling assembly (14) and clamping lever (25) engaging with the turntable (4) are provided for the rotational movement of the rotary slide valve (4). The coupling assembly (14) has a pivoted lever (20) having an articulated joint (21) formed on one end which in turn is formed on a bearing block (19), arranged locally fixed and slideable. An adjusting drive (30) for altering the position of the bearing block (19) is provided independent from the crankshaft-type drive.

5 Claims, 4 Drawing Sheets

METERING PUMP FOR HIGHLY VISCOUS FILLINGS

FIELD OF THE INVENTION

The invention refers to a metering pump for highly viscous fillings having a crankshaft-type drive for a back-and-forth movement of a piston in a cylinder and a drive for a forward-and-backward rotational movement of a rotary slide valve derived from this, whereby the rotary slide valve has openings and the housing of said rotary slide valve has connections for a suction line and a discharge line for the piston/cylinder unit, and a plate cam, a coupling assembly and a clamping lever engaging with the rotary slide valve are provided for the rotational movement of the rotary slide valve. In particular, the invention refers to a metering pump for introducing appropriate portions (quantities) into a foil chain with very closely spaced successive chambers. Highly viscous fillings are understood to include thick fluid products, pastes or similar products, for example, ketchup, mustard, cosmetic products, toothpaste, etc.

BACKGROUND OF THE INVENTION

A metering pump of the above type is known in which the coupling assembly has a transmission lever which engages on the clamping lever. The clamping lever is mounted radially on the rotary slide valve. The transmission lever is constructed with a variable length. For this purpose, it is subdivided and provided with appropriate threaded parts. The clamping lever engages on the rotary slide valve by means of an adjusting spring so that the radial position of the clamping lever relative to the rotary slide valve and its openings cannot be altered. The length of the transmission lever can only be changed when the metering pump is stationary. Altering the length of the transmission lever changes the position of the rotational angle through which the clamping lever and the rotary slide valve pass during the forward-and-backward rotational movement, while the size of this angle, generally 90°, remains roughly the same upon such a displacement. Such a displacement in the position of the rotational angle, which can only be performed when the metering pump is stationary, is awkward and a disadvantage. The metering pump must be stopped for every single adjustment or readjustment respectively, i.e. the filling process must be interrupted. The housing for the metering pump must be opened at the appropriate point to enable access to the transmission lever. The length can then be modified. Only when the filling process is restarted can it be seen whether or not the adjustment has achieved the desired result. If this is not the case, the entire adjusting procedure must be repeated. Should the viscosity of the filling change during the filling process, something that can happen, then a readjustment is practically impossible with the known metering pump. However, in many cases such a readjustment is highly desirable or even essential with filling processes involving difficult-to-handle fillings. As the rotary slide valve functions, in order to link the container to be filled with the piston/cylinder unit upon the intake (suction) stroke and to block this link upon the expel (eject) stroke as well as to link the piston/cylinder unit with the discharge line, there will always be such relationships whereby the chain of filling at the end of the discharge line, i.e. already on both sides of the rotary slide valve, must tear off in order to supply the respective portion. It is known to suck back filling from the discharge line at the start of the intake stroke of the piston/cylinder unit, whereby said filling then, facing the opposite way to the filling to be delivered being acted upon by gravity, moves upwards or backwards respectively in the discharge line. These two opposed movements are intended to achieve a clean breakage of the filling after each portion. According to the type of filling, this "suck-back" (return) effect has to be set differently and reset in many cases so that just such a clean break in the filling is achieved and so that traces of filling land, for example, on the sealing surfaces of the packaging container for the filling where they might interfere with the sealing. As with such metering pumps the filling volume must also be set, there is the added difficulty that when adjusting the filling volume the relationships at the break-off point of the filling chain will once again change. A relative setting is necessary here. It can be seen that these possibilities for adjustment are unsatisfactory in the case of the known metering pump.

SUMMARY OF THE INVENTION

It is the task of the invention to further develop a metering pump of the type described above in such a way that the position of the rotational angle of the rotary slide valve, and hence the relationships upon breaking off the filling chain, can be changed during the operation of the metering pump. This is valid for both a basic position which, for example, is designed according to the type of filling, and for a readjustment like, for example, if the viscosity of the filling alters.

According to the invention, this is achieved with a metering pump of the aforementioned type in that the coupling assembly has a pivoted lever with an articulated joint formed on one end which is mounted on a bearing block which may be shifted, and that an adjusting drive is provided for altering the position of the bearing block independently from the crankshaft-type drive. An essential component of the coupling assembly is a pivoted lever, whereby such a pivoted lever is understood to be a lever which swings back and forth like a pointer about an articulated joint provided on its end. The remaining components of the coupling assembly do not engage with this articulated joint, but on the contrary, engage on the one hand with the other end of the pivoted lever and furthermore, somewhere in the middle of the pivoted lever. Thus, the opportunity appears of changing the local, fixed position of the articulated joint around which the pivoted lever swings. The adjusting drive which engages with this articulated joint for this purpose is located at rest on the metering pump housing, i.e. does not move with the coupling assembly. It is thereby possible to lead (guide) the adjustment drive out of the metering pump housing and, for example, with the aid of a handwheel, to carry out the rotation delicately sensitive (fine), even during operation of the metering pump. At the same time, such a pivoted lever brings with it the additional advantage that a transmission ratio is achieved with it. The articulated joint or the bearing block respectively, about which the pivoted lever swings back and forth, need only be displaced a relatively short distance in order to be able to adjust the position of the rotational angle according to the transmission ratio of the pivoted lever. The main advantage of such an adjustment can be seen in that it may be utilized while the metering pump is running, and that in doing this, the result of the work can be inspected immediately. Useful readjustments, not possible with the state-of-the-art, can be performed without any further ado. Thus, a better and above all quicker adaptation to the various parameters of the filling is possible. One part of the metering pump intake stroke, at the start of said stroke, is used to draw up or withdraw respectively the chain of filling material in the discharge line in order to achieve a clean, reproducible break in the filling and to avoid subsequent leakage of the filling.

In detail, the coupling assembly can have a connecting rod engaging with the plate cam, the pivoted lever and a transmission lever linked to the clamping lever, whereby the connecting rod is articulated on the center bearing of the pivoted lever; the articulated joint on the other end of the pivoted lever is then linked to the transmission lever. A simple coupling assembly is thereby produced which achieves the described adjustability and readjustability during operation of the metering pump. Such a coupling assembly is suitable for a metering pump in which a plate cam, mounted on the drive shaft, is employed, whereby the one end of the conecting rod takes its back-and-forth movement from the eccentrically formed periphery or from a slip (slide) groove on the plate cam.

The bearing block can be shifted along a guide bar and may be adjusted via a control spindle, a component of the adjusting screw, by means of a thread. The axes of the guide bar and the control spindle are arranged parallel with each other. Both pass through the bearing block so that this is mounted stationary and cannot be turned but despite this, may be shifted linearly. It is of course also possible to guide the bearing block along a sliding bed and to shift it using just a control spindle alone.

The connecting rod can be usefully guided linearly and its center bearing engaging in the middle zone of the pivoted lever is then arranged in the extension direction of the pivoted lever and so that it may be shifted on this. This ability to be displaced is necessary because the pivoted lever also traces a circular arc movement in its middle zone, while the connecting rod is guided linearly. The differences effected here are thus compensated.

BRIEF DESCRIPTION OF THE DRAWINGS

A preferred embodiment example of the metering pump with the parts essential to the invention is illustrated in the drawings and will be described in the following. They show.

DETAILED DESCRIPTION

Figure 1:
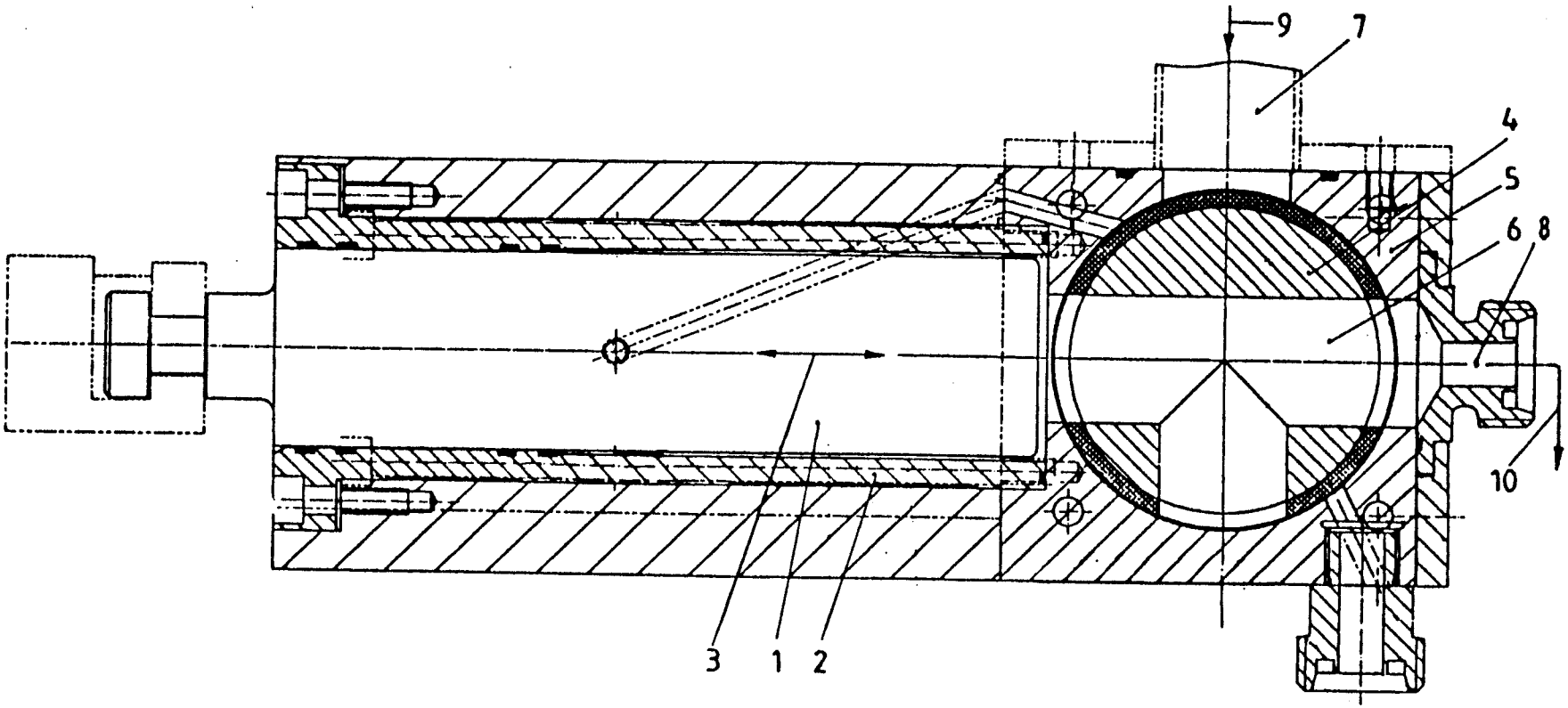
FIG. 1 a vertical section through the rotary slide valve and the piston/cylinder unit of the metering pump connected to this, FIG. 2 a side view of essential parts of the coupling assembly, FIG. 3 a section according to the line III—III shown in FIG. 2, and FIG. 4 a section according to the line IV—IV shown in FIG. 2.

A piston 1 is illustrated in FIG. 1 which is driven back and forth according to arrow 3 in a cylinder. A crankshaft-type drive is provided for this which is, however, not illustrated. The piston is shown at its top dead center position, i.e. at the end of the expel stroke or start of the return stroke respectively. The piston/cylinder unit 1, 2 thus makes a suction or displacement space (chamber) respectively available, thus achieving the pump effect.

A rotary slide valve 4 is allocated to the piston/cylinder unit 1, 2, and is constructed like a shaft and mounted in a housing 5 such that it may turn. The rotary slide valve 4 is penetrated by T-shaped openings 6 which extend radially relative to the axis of the rotary slide valve 4. A suction line 7 is connected to the top of the housing 5 to the rotary slide valve 4, while a discharge line 8 leads off laterally. The suction line 7 is linked to a storage container for filling material so that during the intake stroke of the piston/cylinder unit 1, 2 filling can now flow through the connecting openings 6 according to arrow 9 into the space forming between piston 1 and cylinder 2. During the expel stroke however, the rotary slide valve 4 is in the position shown in FIG. 1, in which the suction line 7 is shut off, so that filling is conveyed through the openings 6 in the prescribed quantities into the discharge line 8 and a filling tube (not illustrated) linking this point with a discharge point. The filling is broken off at the end of this filling tube, as described. In order to aid this break-off process, the rotary slide valve 4 remains in the position shown in FIG. 1 for a certain range (length) at the start of the intake stroke of the piston/cylinder unit 1, 2 so that the filling in the filling line is sucked up in the opposite direction to arrow 10. Thus, subsequent leakage of drops of filling material is also avoided.

Figure 2:
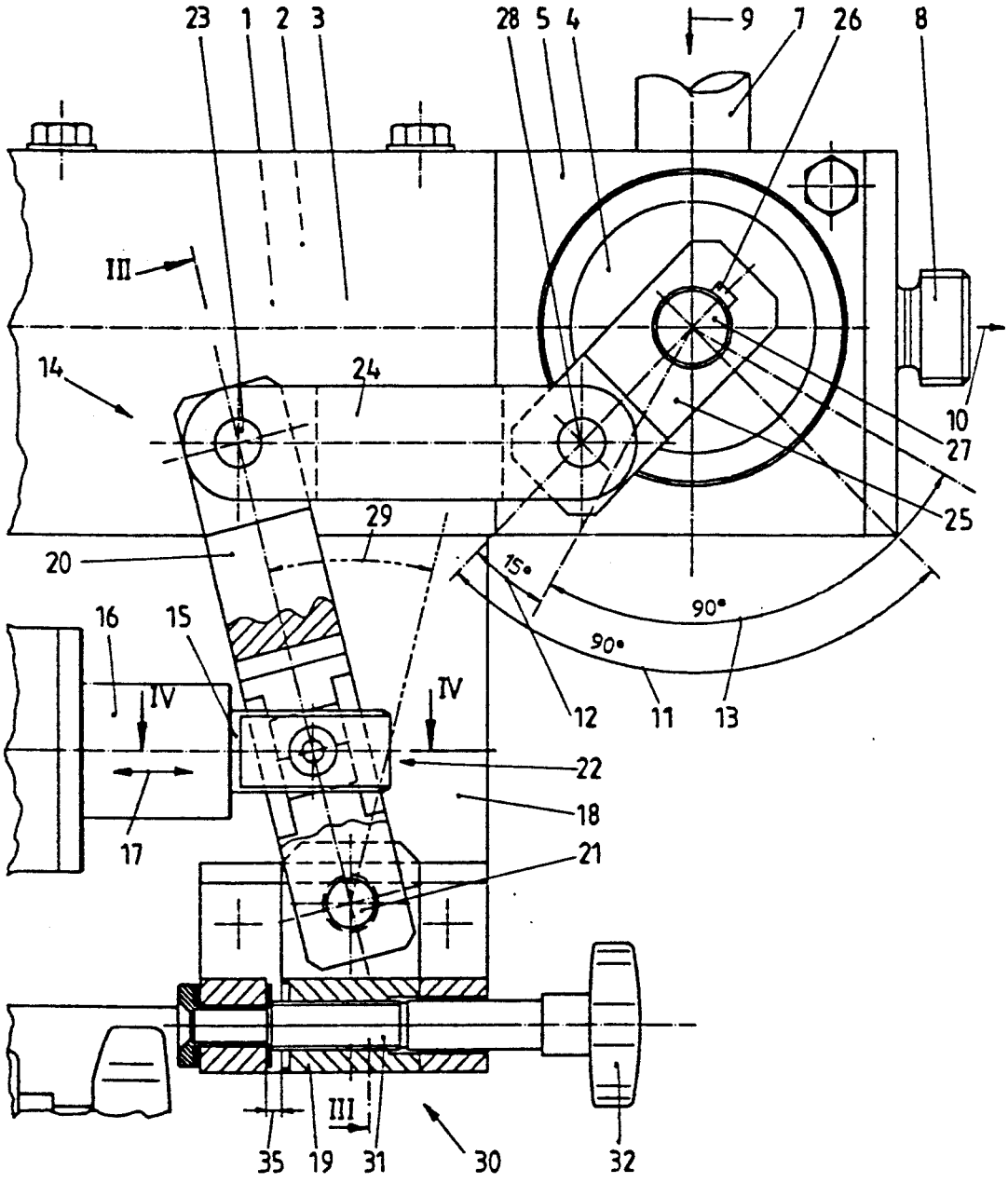

It can be seen that the rotary slide valve 4 must pass through an angle of roughly 90° on the forward and backward movement. The basic position 11 of this pivoting range is shown in FIG. 2. A range of adjustment 12 is illustrated which can be approx. 15° here. It can thus be seen that the maximum alteration to the relative position of the pivoting range 11 is roughly the range of adjustment 12. The maximum altered pivoting range 13 is the position of the pivoting angle at which the maximum return of the filling in the direction opposite to that of arrow 10 is reached.

A coupling assembly 14 in the drive train is employed for the forward-and-backward rotational movement of the rotary slide valve 4. The coupling assembly 14 has a connecting rod 15 (see also FIG. 4) which is guided linearly with the aid of a bearing bush 16. The connecting rod traces a linear back-and-forth movement according to arrow 17.

Figure 3:
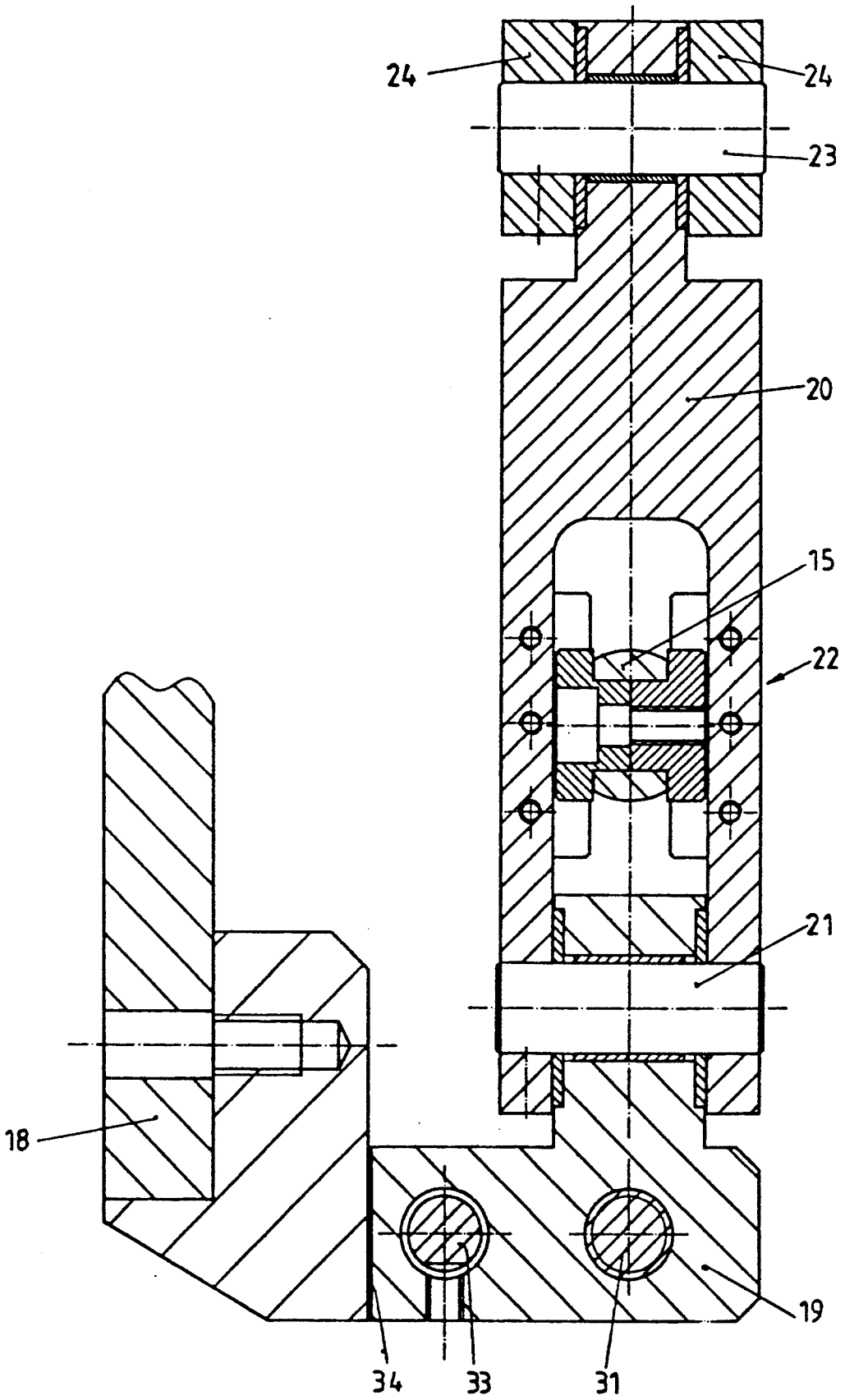

A pivoted lever 20, an essential component of the coupling assembly 14, is provided in a bearing block 19 on the housing or frame 18 respectively. Arranged on one end of the pivoted lever 20 is an articulated joint 21 which links the pivoted lever 20 to the bearing bush 19. Formed in the middle zone of the pivoted lever is a center bearing 22 which links the front end of the connecting rod 15 and engages pivoted lever 20 in an articulated fashion. This center bearing 22 is arranged so that it may be displaced by the required amount in the main extension direction of the pivoted lever 20, as can be particularly well seen in FIG. 3. This ability to be shifted is necessary because the connecting rod 15 traces a linear back-and-forth movement, while the pivoted lever 20 traces a circular arc movement about the articulated joint 21. On the end of the pivoted lever 20 away from the articulated joint 21 there is an articulated joint 23 onto which a transmission lever 24 engages which likewise belongs to the coupling assembly 14. The gearing linkage is supplemented by a clamping lever 25 which is, with the aid of an adjusting spring 26, clamped onto the rotary slide valve 4 such that it cannot turn and in fact, laterally on a shaft-type extension piece. The clamping lever 25 extends radially with respect to the axis of the rotary slide valve 4. The clamping lever 25 and the transmission lever 24 are linked by means of an articulated joint 28. It can be seen that the back-and-forth movement of the connecting rod 15 according to arrow 17 is converted into a back-and-forth swinging movement of the pivoted lever 20 about the articulated joint 21, whereby this movement occurs according to arrow 29. Thus, tile rotary slide valve 4 is transferred into the forward-and-backward movement according to the pivoting range in the basic position 11 via the transmission lever 24 and the clamping lever 25.

In order to alter the relative position of this basic position 11 in the range of adjustment 12, an adjusting drive 30 is provided which engages with the bearing block 19 and thus modifies the relative position of the articulated joint 21 relative to the frame 18. Essential component of the adjusting drive is a control spindle 31, i.e. a threaded bar which is mounted in the frame 18 such that it may rotate and projects out, i.e. is accessible from there, ending in a turning knob 32. The bearing block 19 is not only penetrated by the control spindle 31, on the contrary, also by a guide bar 33, whereby the axes of the control spindle 31 and the guide bar 33 are arranged in line parallel to each other so that in this way, as well as through a slide face 34 on the frame 18, the bearing block can be at last guided linearly on frame 18 such that it may be adjusted. The range of adjustment 35 does not need to be particularly large. In this case 4 mm is sufficient for a range of adjustment of 12° through 15° because the pivoted lever 20 effects a corresponding transmission. The thread on the control spindle 31 is advisably a fine thread in order to enable a sensitive adjustment and readjustment.

Figure 4:
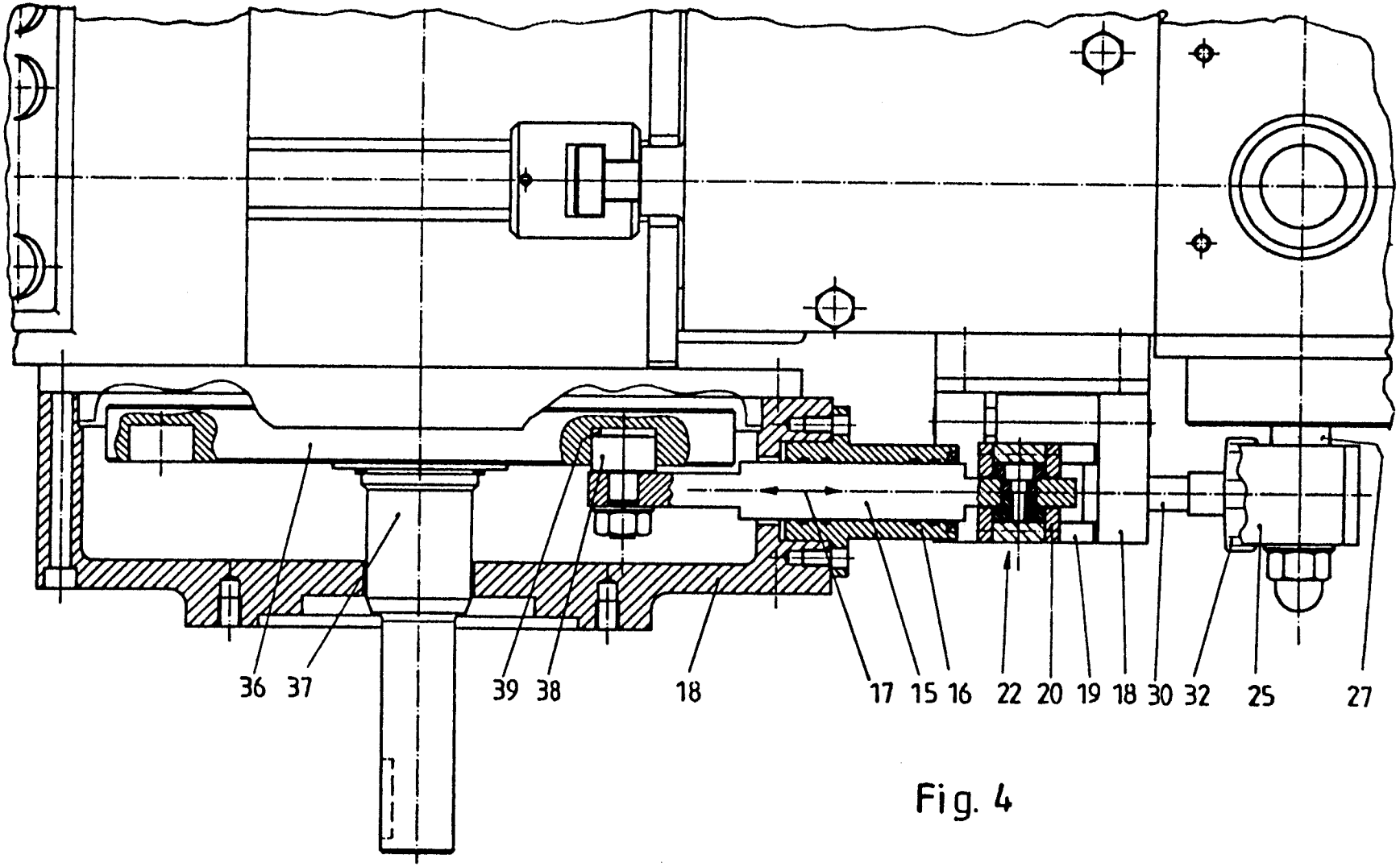

In FIG. 4 it can be seen that the drive for the coupling assembly 14 or the connecting rod 15 respectively is taken from a plate cam 36 which is mounted on a drive shaft 37, a component of the common drive for piston 1 according to arrow 3 and the rotary slide valve 4. The end of the connecting rod 15 facing the plate cam 36 engages, with the help of a slide block 38, in a groove 39 in the plate cam 36. It can be seen that the groove 39 is formed eccentric to the axis of the drive shaft 37 in order to derive, in this manner, the back-and-forth translatory movement of the connecting rod 15 according to arrow 17.

While a preferred embodiment of the invention has been shown and described, variations and modifications thereof can be made without departing from the spirit and scope of the invention as set forth in the following claims.

I claim:

1. A metering pump for highly viscous fillings having a housing defining a cylinder (2), a piston (1) in said cylinder, crankshaft - type drive means (37) for imparting back and forth movements of said piston in said cylinder, a rotary slide valve (4) for controlling the movement of the viscous fillings through the pump, and a drive (36, 15, 14) for imparting rotational movement to said rotary slide valve, said rotary slide valve having connections (6) for a suction line to and a discharge line from the piston/cylinder unit, a plate cam (36) driven by said drive means, a coupling assembly driven by said plate cam, and a clamping lever (25) engaging with the rotary slide valve and said coupling assembly, wherein the coupling assembly comprises:

a pivoted lever (20) having two ends;

an articulated joint (21) formed on one end of said pivoted lever;

a displaceably arranged bearing block (19) supporting said articulated joint; and an adjusting drive (30) for altering the position of said bearing block independently from the crankshaft - type drive and progressively altering the position of the articulated joint independently of said drive means while the metering pump and its rotary slide valve are operating, and altering the position of the rotational angle of the rotary slide valve.

2. The metering pump of claim 1, and further including a guidebar (33) supporting said bearing block (19), and wherein said bearing block (19) is sized and shaped to be shifted along said guidebar (33), and a threaded control spindle (31) for adjusting the position of said bearing block.

3. A metering pump for highly viscous fillings having a pump housing, a cylinder (2) defined within the housing, a piston (1) reciprocatably received in the cylinder, drive means for reciprocating the piston within the cylinder, a suction inlet (9) extending from the cylinder through the housing for communication with a source of viscous fillings, a discharge outlet (10) extending from the cylinder through the housing for delivering viscous fillings from the cylinder, a rotary slide valve (4) for controlling the movement of the viscous fillings through the pump, a plate cam (36) driven by the drive means, a coupling assembly (14) driven by the plate cam, and a clamping lever (25) engaged with the rotary slide valve (4) for oscillating the rotary slide valve, wherein the coupling assembly comprises:

a connecting rod (15) reciprocated by said plate cam (36);

a pivoted lever (20) having two ends;

said connecting rod (15) being connected to said pivoted lever (20) intermediate its ends;

a transmission lever (24) connected at one of its ends to said clamping lever (25) and at its other end to the first end of said pivoted lever (20);

an articulated joint (21) formed on the other end of said pivoted lever (20);

a displaceably arranged bearing block (16) movably mounted on said housing and connected to said articulated joint (21); and an adjusting drive (30) for progressively altering the position of said bearing block on the housing independently of the crankshaft type drive so that the articulated joint (21) can be progressively moved while the metering pump and its rotary slide valve are in operation, for altering the position of the rotational angle of oscillation (11, 12) of the rotary slide valve.

4. A metering pump for highly viscous fillings having a pump housing, a cylinder (2) defined within the housing, a piston (1) reciprocatably received in the cylinder, drive means for reciprocating the piston within the cylinder, a suction inlet (9) extending from the cylinder through the housing for communication with a source of viscous fillings, a discharge outlet (10) extending from the cylinder through the housing for delivering viscous fillings from the cylinder, a rotary slide valve (4) for controlling the movement of the viscous fillings through the pump, a plate cam (36) driven by the drive means, a coupling assembly (14) driven by the plate cam, and a clamping lever (25) engaged with the rotary slide valve (4) for oscillating the rotary slide valve, wherein the coupling assembly comprises:

a connecting rod (15) reciprocated by said plate cam;

a pivoted lever (20) having two ends;

a transmission lever (24) connected between said clamping lever (25) and one end of said pivoted lever (20);

a center bearing (22) attached to said pivoted lever (20) intermediate its ends and connected to said connecting rod (15) for imparting motion to said pivoted lever;

an articulated joint (21) formed on the other end of said pivoted lever;

a displaceably arranged bearing block (19) connected to said articulated joint (21); and an adjusting drive (30) for altering the position of said bearing block (19) and articulated joint (21) with respect to the housing independently of the crankshaft - type drive;

wherein center bearing (22) is connected to and moves with connecting rod (15) to shift pivoted lever (20) in the direction of movement of connecting rod (15) for oscillating the rotary slide valve (4), and the adjusting drive (30) can progressively alter the position of the articulated joint (21) while the metering pump and its rotary slide valve (4) are operating to alter the position of the angle of oscillation (11, 12) of the rotary slide valve.

5. A metering pump for highly viscous fillings comprising:

a pump housing defining a cylinder (2);

a piston (1) reciprocatably received in said cylinder;

drive means (37) for reciprocating said piston;

a suction inlet (7) extending from said cylinder through said housing for communication with a source of the viscous fillings, and a discharge outlet (8) extending from said cylinder through said housing for delivering viscous fillings from said cylinder;

a rotary valve (4) in communication with said cylinder and with said suction inlet and with said discharge outlet (6) for controlling the flow of the viscous fillings through the pump;

said derive means including a rotary plate cam (36) and a connecting rod 915) reciprocated by said plate cam;

a coupling assembly (14) including a lever (20) pivoted at a first end about an articulated joint (21) and connected intermediate its ends in driven relationship to said connecting rod (15);

a transmission lever (24) connected at one of its ends to the second end of said pivoted lever (20);

a clamping lever (25) connected at one of its ends to said transmission lever (24), and at its other end in rotational driving relationship with said rotary valve for oscillating said rotary valve through a rotational angle;

said articulated joint (21) including an adjustable drive (30) for progressively moving said articulated joint independently of said drive means while said metering pump and its rotary slide valve are in operation for altering the position of the rotational angle of the rotary valve.

* * * * *